US009454920B2

(12) United States Patent
Elmore

(10) Patent No.: US 9,454,920 B2
(45) Date of Patent: Sep. 27, 2016

(54) APPARATUS FOR BACKLIGHTING BILLBOARDS USING INDIRECT LIGHT

(71) Applicant: Larry A. Elmore, Richardson, TX (US)

(72) Inventor: Larry A. Elmore, Richardson, TX (US)

( * ) Notice: Subject to any disclaimer, the term of this patent is extended or adjusted under 35 U.S.C. 154(b) by 282 days.

(21) Appl. No.: 14/010,517

(22) Filed: Aug. 26, 2013

(65) Prior Publication Data

US 2015/0055324 A1 Feb. 26, 2015

Related U.S. Application Data

(60) Provisional application No. 61/736,288, filed on Dec. 12, 2012.

(51) Int. Cl.
*G09F 13/04* (2006.01)
*G09F 13/14* (2006.01)

(52) U.S. Cl.
CPC ..... *G09F 13/14* (2013.01)

(58) Field of Classification Search
CPC ..... G02F 2013/049; G02F 2013/0422; G02F 2013/14; G02F 2013/142; G02F 2013/145; G02F 2013/147; G02F 2013/1804; G02F 2013/1831; G02F 2013/1836; G02F 13/14
See application file for complete search history.

(56) References Cited

U.S. PATENT DOCUMENTS 5,612,741 A 3/1997 Loban et al.
5,963,276 A 10/1999 Inbar
7,824,069 B2 11/2010 Ke et al.
8,789,299 B2 7/2014 Hoffman et al.
2006/0267788 A1 11/2006 Delany
2007/0285914 A1* 12/2007 Abogabir ..... G02B 6/0055 362/84
2009/0056183 A1* 3/2009 Reiland et al. ..... 40/564
2010/0236114 A1* 9/2010 Shew ..... 40/564
2011/0222267 A1* 9/2011 Park et al. ..... 362/97.1

FOREIGN PATENT DOCUMENTS

KR 20110000103 U 1/2011
WO 2015031290 A1 3/2015

OTHER PUBLICATIONS

Foreign Communication From a Related Counterpart Application, International Search Report dated Nov. 27, 2014, International Application No. PCT/US14/52586 filed on Aug. 25, 2014.

* cited by examiner

*Primary Examiner* — Andrew Coughlin

(57) ABSTRACT

An apparatus for backlighting a large-scale billboard display using indirect lighting comprises a plurality of edges comprising fasteners to attach to a corresponding number of edges of a frame of the billboard display, the attached edges creating an enclosure. The apparatus further comprises at least one coupling for at least one point light source within the enclosure, the at least one point source light disposed vertically and horizontally off-center from the center point of the enclosure and further disposed above a lower media boundary. The jacket further comprises an interior surface comprising a reflective material having at least two planes of primary reflection capable of diffusing light from the at least one point light source across the rear-facing surface of the frame and an exterior surface that blocks substantially all outside light.

19 Claims, 6 Drawing Sheets

APPARATUS FOR BACKLIGHTING BILLBOARDS USING INDIRECT LIGHT

CROSS-REFERENCE TO RELATED APPLICATIONS

None.

STATEMENT REGARDING FEDERALLY SPONSORED RESEARCH OR DEVELOPMENT

Not applicable.

REFERENCE TO A MICROFICHE APPENDIX

Not applicable.

BACKGROUND

Billboards are structures typically used to display large-scale signage in outdoor locations. These billboards may be free-standing, such as those seen along highways and roads, or installed on another structure, e.g., atop a building or stadium. During daylight hours, the signage may be visible without any additional lighting. Traditional billboards usually contain lighting, such as flood lights, installed on the front of the billboard structure and directed toward the signage in order to light the sign and improve visibility, for instance, during nighttime hours. Newer types of billboards, such as LED (Light Emitting Diode) billboards, use a different lighting system and require an entirely different structure than the lighting system and structure of traditional billboards.

SUMMARY

These and other features will be more clearly understood from the following detailed description taken in conjunction with the accompanying drawings and claims.

In an embodiment, an apparatus for backlighting a large-scale billboard display using indirect lighting comprises a plurality of edges comprising fasteners to attach to a corresponding number of edges of a frame of the billboard display, the attached edges creating an enclosure, at least one coupling for at least one point light source within the enclosure, the at least one point source light disposed vertically and horizontally off-center from the center point of the enclosure and further disposed above a lower media boundary, an interior surface comprising a reflective material having at least two planes of primary reflection capable of diffusing light from the at least one point light source across the rear-facing surface of the frame, and an exterior surface that blocks substantially all outside light.

In an embodiment, an apparatus for backlighting a large-scale billboard display using indirect lighting comprises a plurality of edges comprising fasteners to attach to a corresponding number of edges of a frame of the billboard display, the attached edges creating an enclosure, an interior surface comprising at least two planes of primary reflection capable of diffusing light from at least one point light source to indirectly illuminate the large-scale billboard display, the at least two planes having an angle of primary reflection either greater than ninety degrees or less than ninety degrees to the plurality of edges, the angle of primary reflection adjusted based on the perspective of the billboard display from a point of view of an intended viewer.

In an embodiment, an apparatus for backlighting a large-scale billboard display using indirect lighting comprises a plurality of edges attached to a frame of the billboard display, the attached edges creating an enclosure, at least one coupling for at least one point light source within the enclosure, and at least one opening for the at least one coupling, wherein the opening provides access to the at least one coupling and the at least one point light source.

BRIEF DESCRIPTION OF THE DRAWINGS

For a more complete understanding of the present disclosure, reference is now made to the following brief description, taken in connection with the accompanying drawings and detailed description, wherein like reference numerals represent like parts.

DETAILED DESCRIPTION

Figure 1:
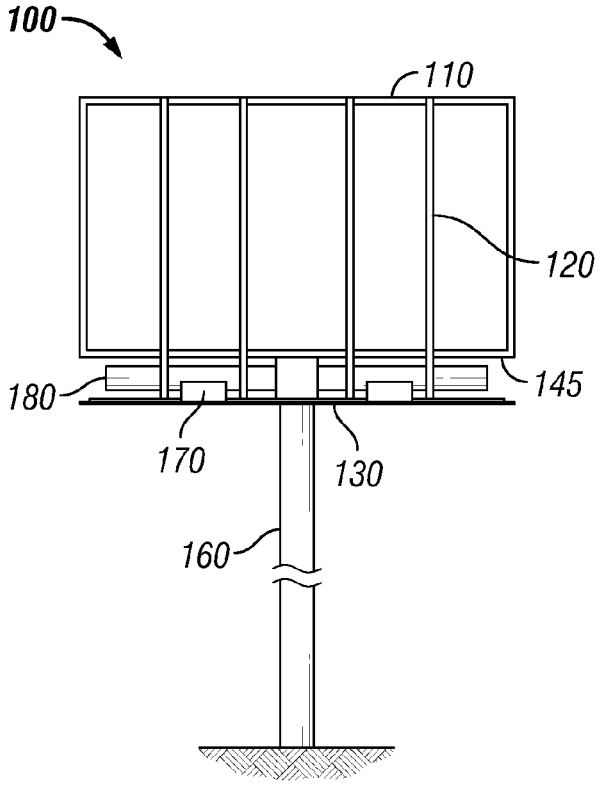
FIG. 1 Prior Art
FIG. 1 illustrates an exemplary traditional billboard structure and billboard frame.

It should be understood at the outset that although illustrative implementations of one or more embodiments are illustrated below, the disclosed systems and methods may be implemented using any number of techniques, whether currently known or not yet in existence. The disclosure should in no way be limited to the illustrative implementations, drawings, and techniques illustrated below, but may be modified within the scope of the appended claims along with their full scope of equivalents.

In order to be effective, signage displayed on a billboard must be clearly visible to a viewer of the sign at all times. For the signage to be visible at night or in diminishing light, additional lighting may be provided on the billboard structure in order to provide the necessary illumination for a viewer to be able to clearly see the sign from the viewer's perspective, typically at a significant distance from the billboard structure. In traditional billboard systems, point light sources, such as floodlights, are typically used to light the billboard.

There are several disadvantages to traditional billboard lighting systems. The light produced by point sources is generally intense, and more likely to produce pronounced shadows. This effect may be observed when floodlights aim light directly at the billboard causing spotting or shading on portions of the billboard. This spotting and shading decreases visibility of the advertisement displayed on the billboard to the intended viewer. Also, the lighting requirements may differ depending on the location of the billboard, for example, depending if the billboard is near a city or in a more rural area. For example, in a city environment, more lights may need to be installed in order to overcome residual city lights, whereas, in a more rural environment, fewer lights may suffice. This necessitates that lighting requirements for each billboard be considered and designed individually as opposed to all billboards having standard lighting requirements regardless of residual light. Another disadvantage is that residual light from flood lights installed on traditional billboards reflects off the billboard causing glare for the viewer, further reducing visibility of the billboard and potentially creating a nuisance to residential areas in the vicinity of the billboard. For example, during evening hours, residents may experience unwanted light reflecting off a nearby billboard that enters bedroom windows and other areas of their homes.

It would be advantageous to provide an internal lighting system for traditional billboards structures using a backlighting effect which better illuminates the signage, thereby making the signage more visible, particularly at night, while diminishing the effects of reflected or refracted light. It would also be advantageous to not only use less lights, regardless of billboard location, but to have similar, if not standard, lighting requirements for all billboard locations. It would be further advantageous to provide this internal lighting system on existing traditional billboard structures which are already installed, rather than incurring costs of replacing the existing traditional billboard structure with new billboard structure simply to improve lighting. For example, replacing a traditional billboard structure with a LED (Light Emitting Diode) billboard structure may not be feasible for many reasons. Considerations may include the cost of an LED billboard structure itself, which may be substantially more than a traditional billboard, the cost of removing the existing traditional billboard and installing the new LED billboard structure, as well as, any zoning considerations for installing a new billboard structure. An additional consideration is the pervasiveness of already installed traditional billboard systems. Thus, it would be advantageous to provide a cost-effective internal lighting system which can be supported by traditional billboard structures and traditional billboard lighting fixtures.

It would be further advantageous to provide an internal backlighting system using indirect light that improves lighting quality for traditional billboard structures, and depending on the quality of the media, e.g. vinyl quality, may approach LED quality lighting, and that further provides easy access to the internal lighting system for maintenance and other purposes without removing installed signage.

Accordingly, an apparatus, system, and method are disclosed herein for providing an internal backlighting system for traditional billboard structures using indirect lighting.

A light box is a type of known backlighting system. A light box, however, is generally used on a much smaller scale than a traditional outdoor billboard structure, for example, a poster-sized display, and thus, is not suitable for use with large-scale billboard. A typical light box may be a closed container with one or more light bulbs installed in the container. The light bulbs backlight a display using direct light, similar to shining a flashlight at the back of the display. However, use of direct lighting on a large-scale billboard display, whether front lighting or backlighting, may cause shading and spotting on a displayed advertisement thereby decreasing the visibility of the displayed advertisement to the user. Light boxes also lack easy access to the light bulbs within the closed container because the container must be removed from the back of the display or the display must be removed from the container in order to reveal the light bulbs. LED-lighted billboards are similar in that the LED lights used for lighting are also mounted in a closed container. Once these types of enclosed lighting systems are in place, access to the light bulbs for maintenance is problematic, particularly when used on large scale displays. Typically in these systems, the light bulbs are installed within a protective metal can or some other protective covering which cannot be accessed except by disassembling the box container or in the case of LED billboards, by first removing the advertisement display. When maintenance is required or lights need to be changed, the display must be removed to access the lights within the protective can. On large scale billboard displays, this can be costly and time intensive.

Figure 2:
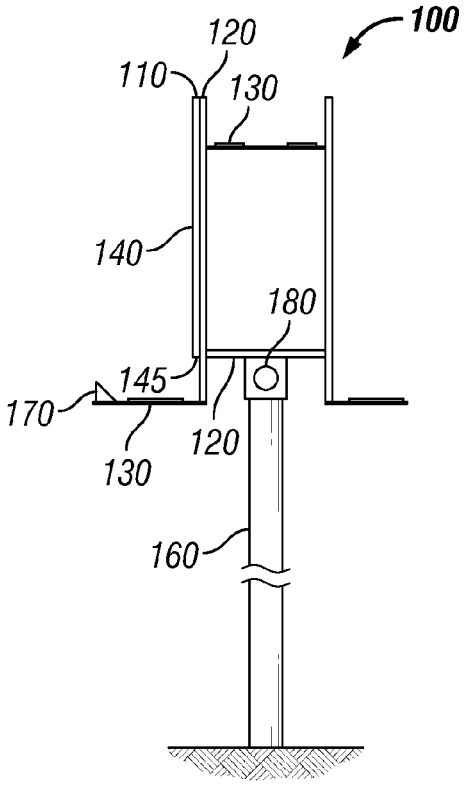
FIG. 2 Prior Art
FIG. 2 illustrates another view of an exemplary traditional billboard structure and billboard frame.

FIG. 1 and FIG. 2 illustrate an exemplary traditional billboard structure 100. Billboard structure 100 comprises a frame 110, a frame support 120, a catwalk 130, signage 140, a post 160, lighting 170, and a torsion bar 180. Post 160 may be comprised of wood, steel, or I-beam. Billboard structure 100 may comprise one or more posts 160 depending on the size and configuration of billboard structure 100. Torsion bar 180 is supported by post 160 and further provides a support on which frame support 120 is attached. The frame support 120 may be comprised of angle iron, reverse angle iron, I-beam or other suitable material. Frame 110 is attached to frame support 120 and may be a rectangular shape with corners at 90 degree angles, although other shapes of frame 110 are contemplated.

Signage 140 may contain information regarding a product or service, such as an advertisement. In an embodiment, signage 140 may comprise vinyl panels which are attached directly on the front surface of frame 110. In another embodiment, signage 140 may comprise a large, continuous plastic or vinyl sheet which covers the front surface and is wrapped around the angle iron frame 110. The perimeter of signage 140 may be referred to as a media display boundary.

A skirt may be installed on frame 110 and may be positioned below frame 110 and the bottom edge of signage 140, also referred to as the lower media boundary 145. A catwalk 130 is attached to frame support 120, and may be comprised of wood or metal. Catwalk 130 extends for at least the width of frame 110 and/or lower media boundary 145 of signage 140. Additional catwalks 130 may be installed on frame support 120 for accessing the upper portion of the billboard 100. Catwalk 130 provides an area for workers to access frame 110, frame support 120, signage 140, and lighting 170 for installation, removal, and maintenance.

Lighting 170 is installed on the billboard structure 100 for illuminating signage 140. Lighting 170 is typically attached to the catwalk 130 of traditional billboard structure 100. Lighting 170 may comprise point light sources, such as, flood lights. When installed on catwalk 130, lighting 170 is mounted in a position extending several feet out in front of signage 140. In an embodiment, lighting 170 extends approximately seven feet from the front of signage 140. Lighting 170 is further positioned at a point below the bottom edge of signage 140, that is, below the lower media boundary 145. Lighting 170 is further positioned at an upward angle and pointed toward frame 110, whereby the front of signage 140 is illuminated by the direct light generated by lighting 170.

Figure 3:
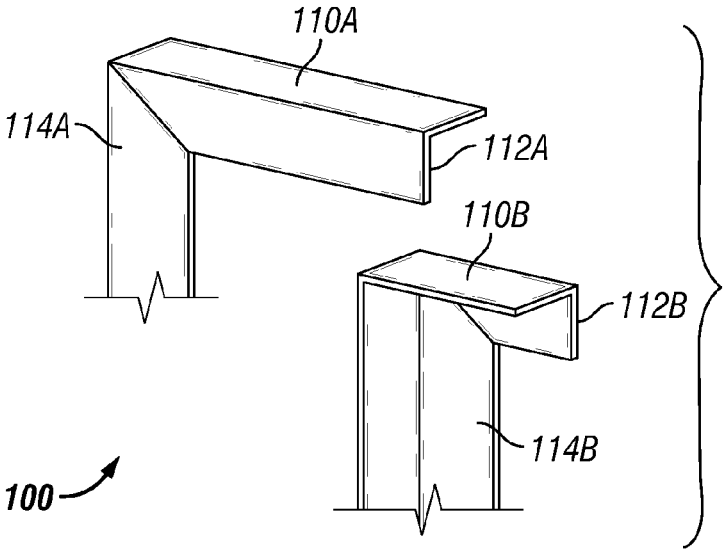
FIG. 3 illustrates a portion of an exemplary angle iron frame.

FIG. 3 depicts a portion of an exemplary angle iron frame 110A and its front surface, or face, 112A and its back surface 114A with corners angled at ninety degrees. Also depicted is a portion of an exemplary reverse angle iron frame 1108 and its front surface, or face, 112B and its back surface 114B. Signage 140 is generally attached or installed to front surface 112A of an angle iron frame and 112B of a reverse angle iron frame. Angle iron frame 110A, face 112A, and back surface 114A, and reverse angle iron frame 1108, face 112B, and back surface 114B, may be generally referred to herein as frame 110, face, and back surface 114, respectively, unless referring specifically to angle iron frame 110A or reverse angle iron frame 1108.

While one exemplary traditional billboard structure 100 is illustrated, it is envisaged that the traditional billboard 100 may vary in structure, material, position and size as is known in the art.

Figure 4:
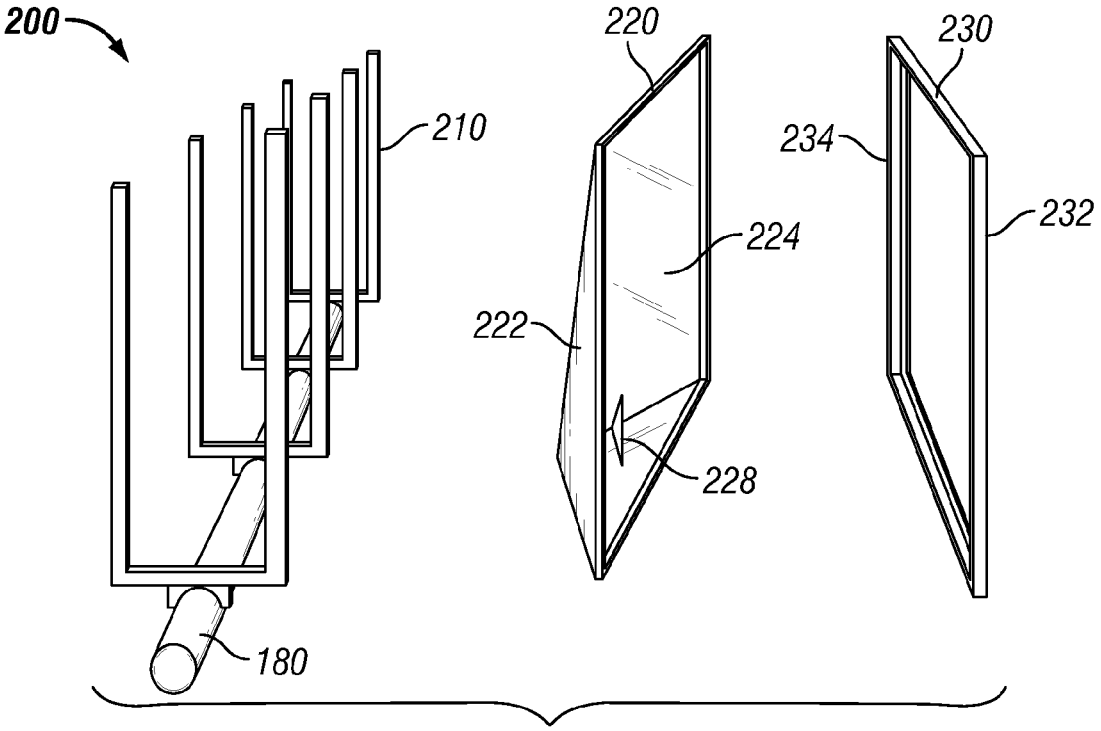
FIG. 4 illustrates components of a traditional billboard and an exemplary generic jacket apparatus.

FIG. 4 illustrates certain components of a traditional billboard 200 and an exemplary generic jacket apparatus 220 for providing an internal backlighting system for billboard 200 using indirect light. Jacket 220 as depicted is a generic jacket because while each jacket has certain standard features, other features of the jacket may vary from billboard to billboard, as discussed herein. Frame support 210 of traditional billboard 200 comprises horizontal and vertical poles, aligned and spaced to create a support for frame 230. Jacket 220, illustrated from an angled side view, provides the internal backlighting system. Jacket 220 has a jacket exterior 222 and a corresponding interior surface 224 each comprising a plurality of sides. Jacket 220 further comprises an opening 228 for a point light source. Jacket exterior 222 is attached to frame support 210 when installed. While not illustrated, in an embodiment, the backlighting for a billboard may be provided by multiple jackets. Multiple jackets may be used for very large scale billboards, for example, for ease of handling and installation. In another embodiment, multiple jackets may be used to provide different lighting effects from jacket to jacket of a multiple-jacket installation. However, design and use of multiple-jacket installations are not limited to these situations and other situations in which a multiple-jacket configuration may be beneficial are contemplated.

Traditionally, signage is attached to a front surface, or face, 232 of frame 230 while jacket 220 is attached to the rear surface 234 of frame 230. The front surface 232 and rear surface 234 of frame 230 are parallel surfaces. Frame 230 is attached to frame support 210 at the rear facing surface 234. However, in order to attach frame 230 to frame support 210 and also accommodate attachment of jacket 220 to frame 230, minor modifications may be required to billboard structure 200.

Figure 5:
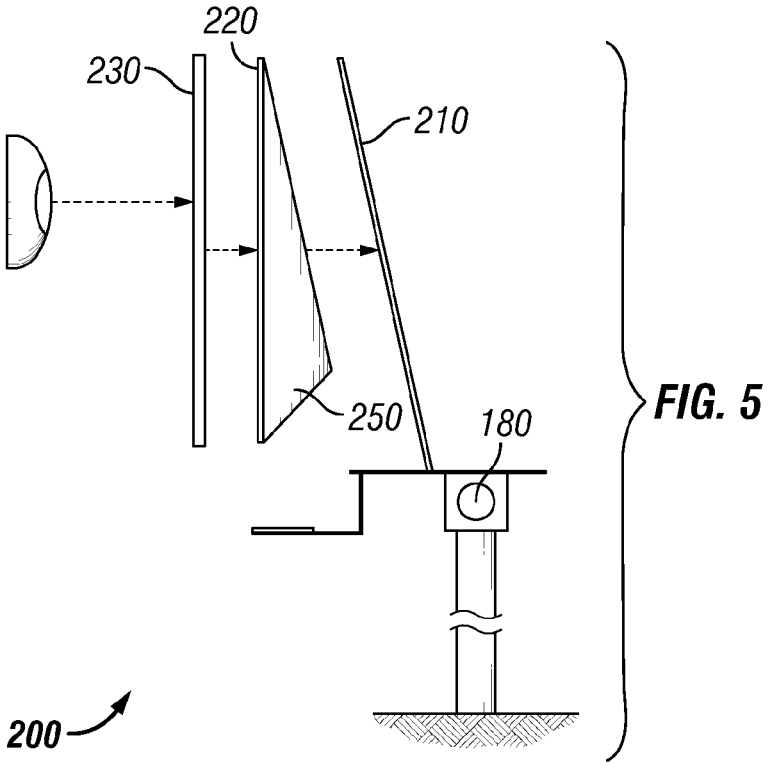
FIG. 5 illustrates an exemplary modified billboard for attaching a frame and jacket.

FIG. 5 illustrates an exemplary modified billboard 200 for attaching frame 230 and jacket 220. In an exemplary embodiment, frame support 210 is modified to accommodate installation of jacket 220 between frame support 210 and frame 230. In this example, frame support 210, consisting of I-beam supports, for example, is angled parallel to the angle of the jacket exterior 250. The modified frame support 210 is non-parallel with frame 230. This type of modification may be suitable for a traditional V-shaped billboard structure, for example.

Figure 6:
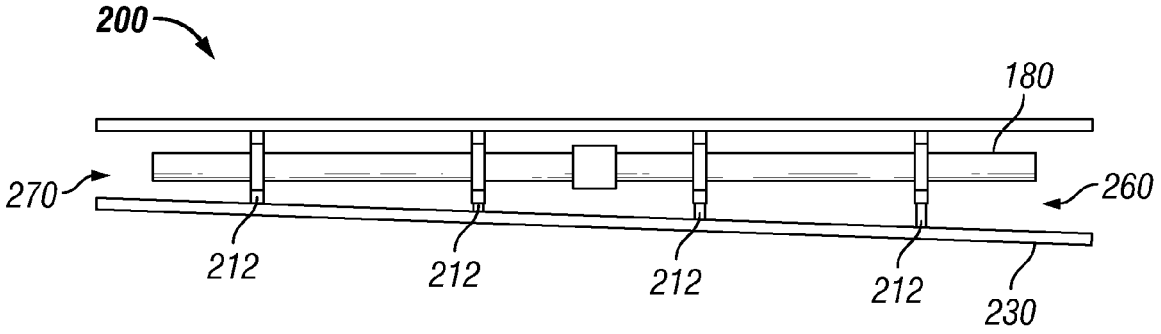
FIG. 6 illustrates a view from above of an exemplary modified billboard for attaching a frame and jacket.
Figure 7:
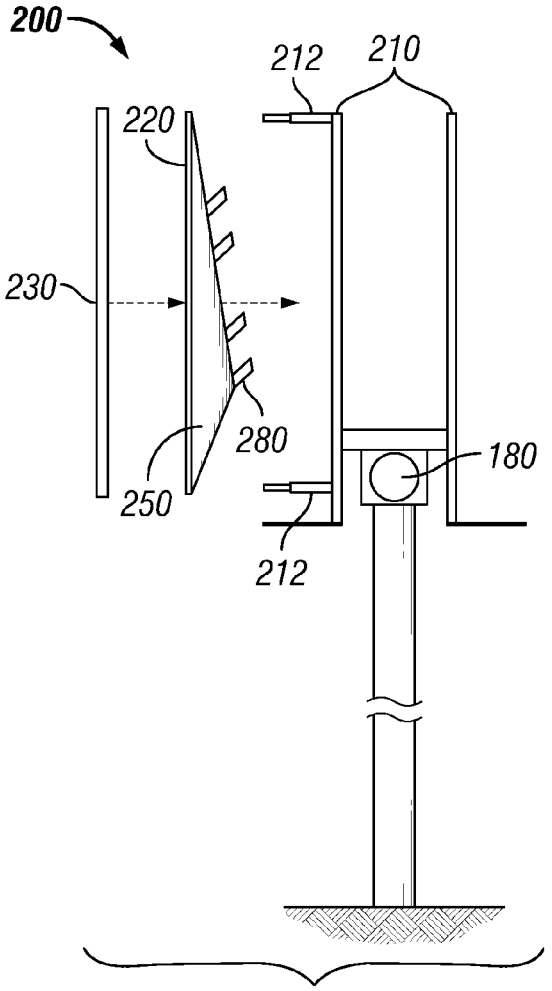
FIG. 7 illustrates a side view of an exemplary modified billboard for attaching a frame and jacket.

FIG. 6 and FIG. 7 illustrate a top view and a side view of another exemplary modified billboard 200 for attaching frame 230 and jacket 220 to frame support 210. In this embodiment, billboard 200 is modified by adding extensions 212 to the top and bottom of frame support 210. Extensions 212 accommodate the depth of jacket 220 when installed to frame 230. In an embodiment, extensions 212 extend from uprights of frame support 210. Frame 230 is installed by attaching frame 230 to extensions 212 of frame support 210. Modification using extensions may be suitable for a back-to-back style billboard or a V-shaped type billboard.

In an embodiment, each of extensions 212 extend from frame support 230 an equal distance, such that frame 230 is attached parallel to the uprights of frame support 210. However, in some situations, the extensions 212 may be of varying increasing or decreasing lengths. The top view of modified billboard 200 illustrated in FIG. 6 depicts each extension 212 extending frame support by varying lengths. By varying the length of the extensions 212, varying dimensions of jacket 220 may be accommodated. In particular, dimensions of jacket 220 may vary for each billboard based on size, type, and orientation of signage. In an embodiment, the billboard may be oriented so that the billboard is neither parallel nor perpendicular to the roadway. For example, the modified billboard 200 may be oriented at an angle to match the point of view, or perspective, of an intended viewer. The perspective of an intended viewer may be, for example, a point of view from a roadway while driving a car at a speed of 40 miles per hour approaching a billboard on the right side of the roadway. Further, the billboard may be positioned at an angle such that the right, or far, side 260 of the billboard is angled away from the roadway and the intended viewer, and the left, or near, side 270 of the billboard is angled toward the roadway and the intended viewer. Because brightness drops off with increasing distance between the intended viewer and the object, the shape of the jacket may be adjusted to account for brightness across the shape of the sign. Due to the size of large-scale billboards, the distance may be significant between the far side 260 and the near side 270 depending on the angle of the billboard. Accordingly, a billboard that is angled with respect to an intended viewer may require more light to adequately illuminate the far side 260 and less light to adequately illuminate the near side 270.

To accommodate the orientation and/or angle of the billboard, jacket 220 may be dimensioned to provide lighting according to several factors, including, the orientation and/or angle of the billboard, the distance from the billboard to the intended viewer at both the far side 260 and the near side 270, brightness, number, and positioning of the lights of lighting fixtures. For example, more light may be required on the portion of signage that is angled away, that is, at the far side 260, from the intended viewer, and less light may be required on the portion of signage that is angled nearer, at the near side 270, to the intended viewer. To accommodate these varying lighting requirements across the sign, the depth of jacket 220 may be adjusted such that the depth of jacket 220 is widest at the far side 260 where the billboard is angled away from the intended viewer and the depth of jacket 220 is narrowest at the near side 270 where the billboard angled toward the intended viewer.

Lighting fixtures are positioned within the jacket at or near opening 228, as shown in FIG. 4, to provide more indirect light to the portion of the billboard where the depth of jacket 220 is greatest. Conversely, less light may be required at the edges of the billboard where the depth of the jacket 220 with respect to the frame edge is decreasing. By positioning the light fixture accordingly, the angles of the jacket with respect to the frame create a continuous gradation of luminosity, that is, less light intensity toward the frame edges. This lighting effect thereby provides the same contrast at the frame edges with less brightness.

Thus, not only may the size and shape of jacket 220, as well as the location of the lighting fixture within the jacket, be modified to suit the orientation and/or angle of the billboard, but extensions 212 may be modified to accommodate the varying dimensions of the jacket. In an exemplary embodiment, regardless where the lighting fixture is located or positioned within jacket 220, the lighting fixture is positioned such that the light is generally directed away from traffic approaching the billboard. This provides the further advantage of reducing bright spots or glare to the viewer at particular angles when nearing the billboard.

Jacket 220 may be made of vinyl, fabric, or other suitable material. In an embodiment, jacket 220 may be rigid enough to maintain its shape when installed. In another embodiment, jacket 220 may be flexible so that the jacket may give or partially collapse, for example, in heavy wind in order to preserve the integrity of the jacket and other parts of the billboard structure. A flexible jacket may be advantageous over a rigid jacket with respect to ease of manufacturing and modifying the jacket, as well as, ease of shipping and transport of the jacket to a billboard location. Jacket exterior 250 may be attached to frame support 210 with at least one attachment 280. In a non-limiting example, attachment 280 may be an attachment with a spring to provide a flexible tension. For example, the spring may provide enough tension to keep the jacket taut in light winds, but may allow the jacket to yield temporarily when experiencing high winds. In other embodiments, attachment 280 may be the spring, as discussed, a screw, a fastener, a tie, etc. or any combination for securing jacket 220 to the frame support 210. Attachment 280 may be comprised of a material, such as, metal, plastic, fabric, etc. or a combination of materials.

Because the shape of jacket exterior 250 varies, attachment 280 may similarly vary in size depending on the distance the jacket exterior 250 is from frame support 210. Referring to FIG. 6, multiple attachments 280 may be used to secure jacket 220 to frame support. The embodiment illustrated in FIG. 5, however, may require a different number of attachments 280 and configuration of the placement of the attachments 280 than shown in FIG. 6. For example, referring to FIG. 5, jacket exterior 250 is closer in proximity to the modified frame support 210 because frame support 210 is modified to be parallel to jacket exterior 250. In contrast, in FIG. 6, the distance of jacket exterior 250 to frame support 210 depends both on the shape of jacket exterior 250 and the length of extensions 212.

It is noted that the exemplary modifications of traditional billboard 100 illustrated in FIGS. 5 and 6 are not intended to limit the manner in which traditional billboard 100 may be modified in order to accommodate attaching generic jacket 220 and frame 230 to frame support 210. Rather, the type of modification may be decided based on style of billboard, cost for the modifications, size of the billboard, dimensions of generic jacket 220, preference of the billboard owner, etc.

Figure 8:
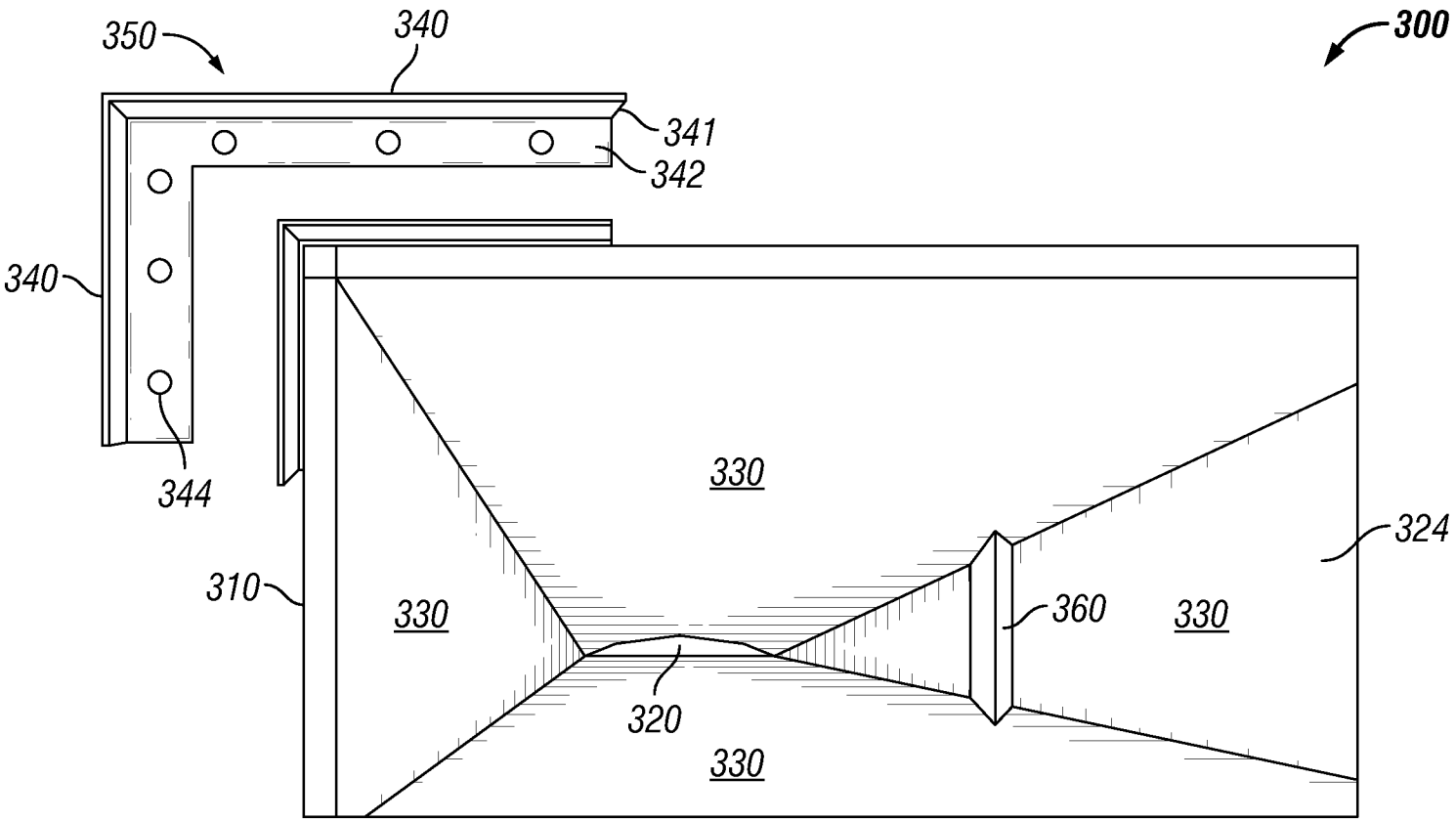
FIG. 8 illustrates the front, interior view of an exemplary jacket and a partial representation of a frame.

FIG. 8 illustrates the front, interior view of exemplary jacket 300 and partial representation of frame 350. The front of jacket 300 comprises jacket edges 310 which border the perimeter of jacket 300. The number of jacket edges 310 corresponds to the number of frame edges 340 of billboard 100, and each jacket edge 310 is substantially the same dimension of the corresponding frame edge 340. For example, if a billboard is a rectangular shape with four-sides, jacket 300 will have corresponding dimensions. That is, the length of the two horizontal frame edges 340 and the length of the two horizontal jacket edges 310 will be substantially the same, and the height of the two vertical frame edges 340 and the height of the two vertical jacket edges 310 will be substantially the same. Jacket 310 further comprises a closable opening 320 for a lighting fixture. For example, the closable opening 320 may be opened to install, access, or perform maintenance on the light fixture within the interior of jacket 300 and may be securely closed at all other times.

In an exemplary embodiment, frame 350 is made of reverse angle iron. The interior vertical surface 342 of frame 350 comprises openings 344 for attaching jacket 300 to frame 350 with fasteners. Jacket edges 310 may be attached flush to interior vertical surface 342 using the fasteners. In an embodiment, vinyl signage may be wrapped around the reverse angle iron and attached under the surface 341, which surface 341 is perpendicular to the interior vertical surface 342. An advantage of using the reverse angle frame with the plastic or vinyl sheet it that by wrapping the vinyl sheet around the reverse angle iron frame, the jacket may be installed or removed from frame 350 without interfering with signage installed on the exterior reverse angle iron frame 340. Similarly, the signage may be installed and removed without disturbing the jacket.

When jacket edges 310 are securely attached to frame 340, an enclosure is created between frame 340 and jacket 300. The enclosure protects the lighting fixtures from the elements and weather, as well as, blocking outside light from entering the enclosure and preventing light from escaping the enclosure.

The interior surface 324 of jacket 300 has a multi-planar reflective interior surface. For example, the interior surface may be vinyl with a silver lining or painted with silver reflective paint. Each plane, or side, of interior surface 324 may be non-parallel to one or more other sides of interior surface 324. The angles created by the planes of the interior surface 324 may comprise angles complementary to the angles created by the respective sides of the exterior surface (not shown). Interior surface 324 may further comprise a plurality of planes of primary reflection. For example, the interior surface 324 may comprise four planar surfaces 330, although it is contemplated that an interior surface 324 may contain more or fewer planar surfaces 330 in order to maximize the lighting effect depending on the size and dimensions of a particular billboard. One or more of planar surfaces 330 may be angled either greater than ninety degrees or less than ninety degrees with respect to the face of a frame. That is, one or more planar surfaces 330 may not be perpendicular with respect to the surface of the frame. Light generated by a lighting fixture installed near closable opening 320 may be reflected off the multiple planar surfaces 330 of the interior surface 324 causing indirect backlighting of the signage installed on frame 350. The planar surfaces 330 reflecting the direct light may also referred to as planes of primary reflection. In another embodiment, one or more light dispersing components 360, may optionally be positioned in the interior of jacket 300 which may act to further reflect and/or refract light from the lighting fixture. The one or more light dispersing components 360 are positioned according to dimensions and proportions of the jacket and signage. In an embodiment, the light dispersing components may be wedge-shaped, however, the light dispersing components may be of other shapes and sizes depending on the lighting requirements for a particular billboard. It is noted that using a jacket to provide backlighting using indirect light does not prohibit the use of other types of direct lighting on other portions of the billboard signage, for example, for lighting cutouts which may extend beyond the frame.

Figure 9:
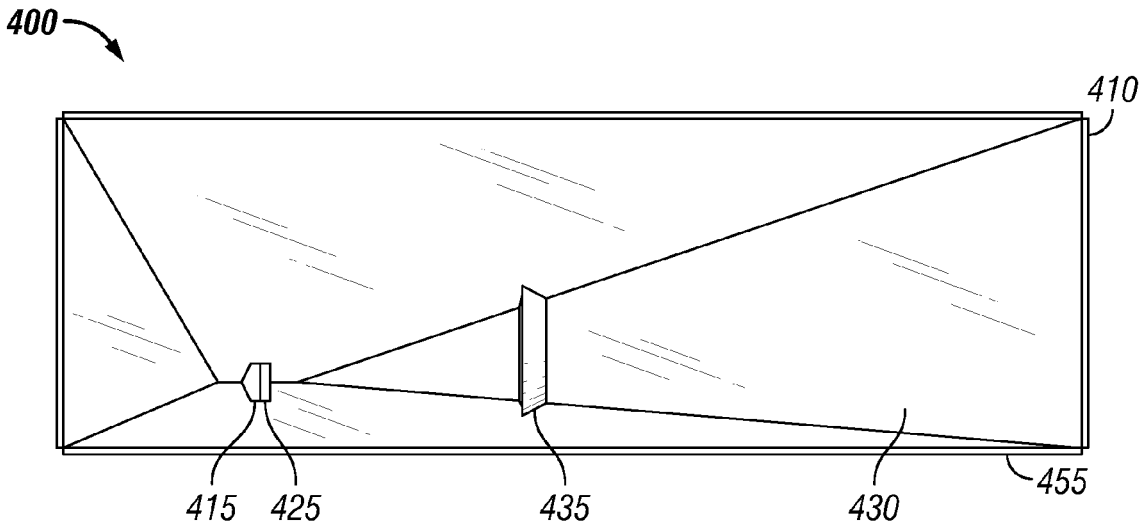
FIG. 9 further illustrates an interior view of an exemplary jacket comprising a light fixture and an exemplary positioning of the light fixture within jacket.

FIG. 9 further illustrates an interior view of an exemplary jacket 400 comprising a light fixture 415 and an exemplary positioning of the light fixture 415 within jacket 400. The light fixture 415 may comprise a coupling for installing or attaching a light source and the light source itself, for example, a light bulb or flood light. The light source may be any suitable light source capable of providing the requisite edge-to-edge illumination of the billboard. Advantageously, light fixtures and light sources for lighting traditional billboards may be used with jacket 400. Light sources for traditional billboards are typically point light sources, which are the most cost effective. Incandescent, halogen and LED lamps are types of point light sources, but other types of point light sources are contemplated for use with jacket 400. This reuse of point light source light fixtures with jacket 400 is advantageous and cost-effective as no new investment in light fixtures or light bulbs is required.

Jacket 400 may comprise one or more light fixtures 415. The number of light fixtures 415 may be determined by the type and size of the billboard, the dimensions of the jacket, the type of light source, or any other considerations for providing better luminosity and for evenly lighting the entire billboard. The direct light generated by the one or more light fixtures 415 may be reflected, refracted, or absorbed by the multiple planar surfaces 430 before indirectly lighting the billboard display. Light fixtures 415 may be positioned to be rear-facing such that light generated by the light source is directed up and away from the frame and the installed signage and toward the rear of the interior of jacket 400. Light fixture 415 may be further positioned in an off-center position, both horizontally and vertically, with respect the surface of frame and jacket edges 410. Light fixture 415 may further be positioned above a lower media boundary. The lower media boundary may be determined by the bottom edge of signage installed or attached on frame and further may be located at substantially the same position as the bottom of lower frame edge 455 of the frame.

An optional light dispersing component 435 may be positioned in the interior of jacket 400 which further absorbs, reflects, or refracts light generated by the light source. In an embodiment, light fixture 415 may comprise a light blocker 425 that blocks all or substantially all direct light between the light source of light fixture 415 and signage 140 installed on frame 110. In an embodiment, the light blocker may comprise a lens component in which the light is blocked or refracted with the lens component.

Figure 10:
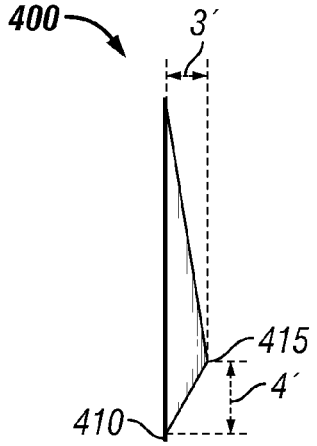
FIG. 10 illustrates a side view of exemplary jacket interior.

FIG. 10 illustrates a side view of exemplary jacket interior 400. The positioning of light fixture 415 is indicated with respect to the exterior surface of jacket 400. The depth of jacket 400 may be measured from edge 410. In an embodiment, the depth of jacket 400 is approximately three feet, and therefore, the jacket extends out three feet from the jacket edge 410. In an exemplary embodiment, light fixture 415 is positioned approximately four feet above the bottom edge 410, or the lower media boundary 455 as shown in FIG. 9. FIGS. 5 and 6, previously discussed, illustrate exemplary modifications to a traditional billboard structure in order to accommodate the depth of jacket 400.

Figure 11:
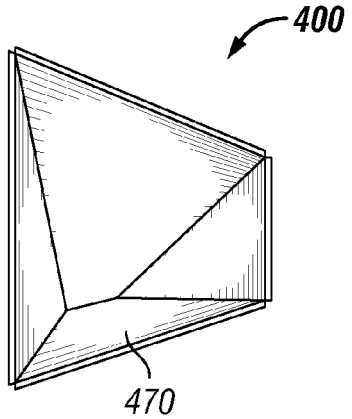
FIG. 11 illustrates an exterior view of an exemplary jacket.

FIG. 11 illustrates an exterior view of exemplary jacket 400. The dimensions of exterior surfaces 470 are equivalent to the dimensions of interior surfaces 324, as described with respect to FIG. 8. In an exemplary embodiment, the exterior surface 470 of jacket 400 has a black coating or other light scattering finish to avoid reflecting light and/or causing glare from any outside light.

Figure 12:
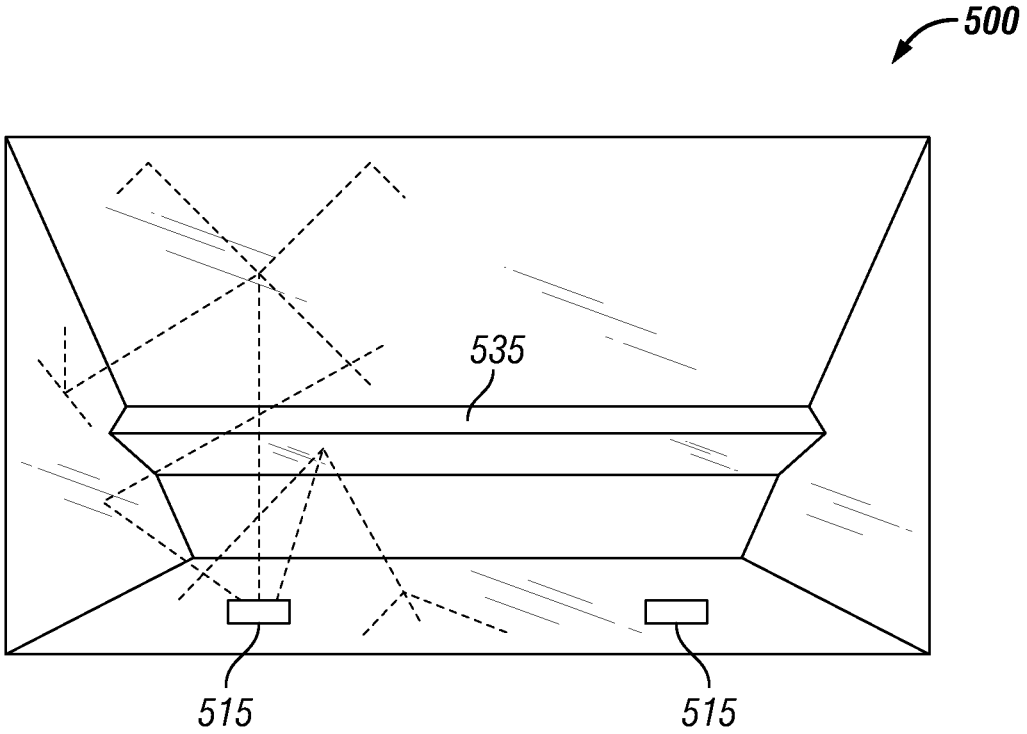
FIG. 12 illustrates an interior view of exemplary jacket with exemplary positioning of two light fixtures within jacket.
Figure 13:
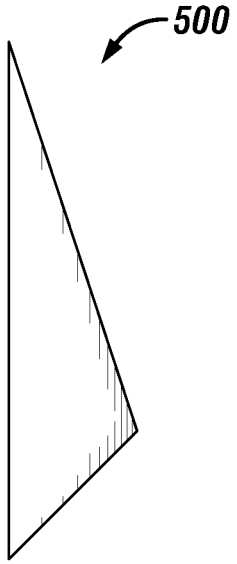
FIG. 13 illustrates another view of exemplary jacket.
Figure 14:
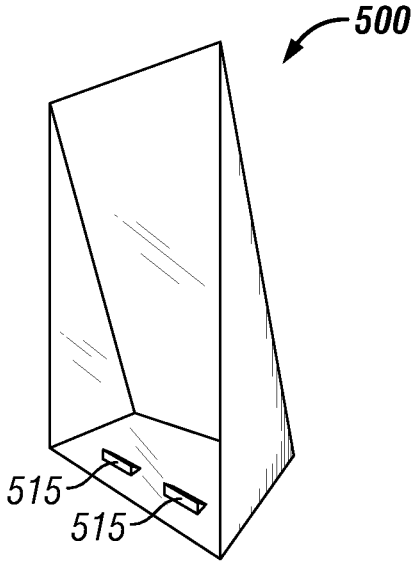
FIG. 14 illustrates another view of exemplary jacket.

FIGS. 12-14 illustrate several views of exemplary jacket 500. In an embodiment, jacket 500 may support two light fixtures 515. Jacket 500 provides a closable opening at the position of each light fixture 515 to provide access for installation and maintenance of light fixtures 515. The light dispersing component 535 may extend across the entire width of the interior of jacket 500. FIGS. 12 and 14 further illustrate that light fixtures are positioned above the lower media boundary 455. The exemplary jacket 500 may be a jacket suitable for a V-shaped billboard structure.

While several embodiments have been provided in the present disclosure, it should be understood that the disclosed systems and methods may be embodied in many other specific forms without departing from the spirit or scope of the present disclosure. The present examples are to be considered as illustrative and not restrictive, and the intention is not to be limited to the details given herein. For example, the various elements or components may be combined or integrated in another system or certain features may be omitted or not implemented. The description of exemplary jackets herein is not intended to limit the size, dimensions, position and number of light fixtures, position and size of light dispersing components of a particular jacket. Rather, because the disclosed jackets are intended for use with existing traditional billboards which may be of any size, shape and type, the jackets are further intended to be adaptable to meet the lighting and engineering requirements of each individual billboard.

Also, techniques systems, and methods described and illustrated in the various embodiments as discrete or separate may be combined or integrated with other systems, techniques, or methods without departing from the scope of the present disclosure. Other items shown or discussed as directly coupled with each other may be indirectly coupled through some device, or intermediate component, whether electrically, mechanically, or otherwise. Other examples of changes, substitutions, and alterations are ascertainable by one skilled in the art and could be made without departing from the spirit and scope disclosed herein.

What is claimed is:

1. An apparatus for backlighting a large-scale billboard display using indirect lighting comprising:

a plurality of edges comprising fasteners to attach to a corresponding number of edges of a frame of the billboard display, the attached edges creating an enclosure and located at the front of the enclosure;

at least one coupling for at least one point light source within the enclosure, the at least one point source light disposed vertically and horizontally off-center from the center point of the enclosure and further disposed above a lower media boundary;

an interior surface comprising a reflective material having at least two planes of primary reflection capable of diffusing light from the at least one point light source across the rear-facing surface of the frame;

an exterior surface that is non-parallel to the billboard display and blocks substantially all outside light; and at least one opening for the at least one coupling, the at least one opening located at the back of the enclosure, wherein the at least one opening at the back of the enclosure provides access to the at least one coupling and the at least one point light source.

2. The apparatus of claim 1, wherein the at least one point light source comprises a light blocker to block substantially all direct light from the rear-facing surface of the frame.

3. The apparatus of claim 1, wherein the enclosure is protected from external weather elements and substantially all outside light.

4. The apparatus of claim 1, wherein the at least one point light source is disposed above a lower media boundary on the billboard display.

5. The apparatus of claim 1, wherein the dimensions of the plurality of edges are the same dimensions of a media boundary of the billboard display.

6. The apparatus of claim 1, wherein the at least one point light source is angled to direct its light toward the back of the interior surface of the apparatus.

7. The apparatus of claim 1, further comprising at least one attachment on the exterior surface of the apparatus, wherein the attachment attaches the apparatus to a frame support.

8. An apparatus for backlighting a large-scale billboard display using indirect lighting comprising:

a plurality of edges comprising fasteners to attach to a corresponding number of edges of a frame of the billboard display, the attached edges creating an enclosure and located at the front of the enclosure;

at least one coupling for at least one point light source within the enclosure;

a concave interior surface comprising at least two planes of primary reflection capable of diffusing light from the at least one point light source to indirectly illuminate the billboard display, the at least two planes having an angle of primary reflection either greater than ninety degrees or less than ninety degrees to the plurality of edges, and the angle of primary reflection adjusted based on the perspective of the billboard display from a point of view of an intended viewer;

a convex exterior surface that is non-parallel to the billboard display; and at least one opening for the at least one coupling, the at least one opening located at the back of the enclosure, wherein the at least one opening at the back of the enclosure provides access to the at least one coupling and the at least one point light source.

9. The apparatus of claim 8, wherein a depth of the apparatus varies based on the angle of the billboard from the perspective of the intended viewer.

10. The apparatus of claim 9, wherein the depth of the apparatus is greatest at a point where the billboard display is angled away from the viewer.

11. The apparatus of claim 9, wherein the depth of the apparatus at its greatest point is approximately three feet.

12. The apparatus of claim 9, wherein the depth of the apparatus is narrowest at a point where the billboard display is angled nearer to the viewer.

13. The apparatus of claim 8, wherein the apparatus is attached to a plurality of extensions of the billboard display, and wherein a length of each of the plurality of extensions is equal to the depth of the apparatus at a point of attachment to the extension.

14. The apparatus of claim 8, wherein the apparatus is attached to at least one angled support of the billboard display, wherein the at least one angled support is modified to accommodate the depth of the apparatus.

15. An apparatus for backlighting a large-scale billboard display using indirect lighting comprising:

a plurality of edges attached to a frame of the billboard display, the attached edges creating an enclosure, and the plurality of edges located at the front of the enclosure;

at least one coupling for at least one point light source within the enclosure;

at least one opening for the at least one coupling, the at least one opening located at the back of the enclosure, wherein the at least one opening at the back of the enclosure provides access to the at least one coupling and the at least one point light source.

16. The apparatus of claim 15, wherein the attached apparatus does not overlap any portion of a media boundary installed on the frame of the billboard display.

17. The apparatus of claim 15, wherein the at least one opening is accessible from the exterior of the apparatus.

18. The apparatus of claim 15, wherein the at least point light source is directly accessible via the at least one opening.

19. The apparatus of claim 15, wherein the at least one opening is accessible via a catwalk.

* * * * *